US010337170B2

(12) United States Patent
Joung et al.

(10) Patent No.: US 10,337,170 B2
(45) Date of Patent: Jul. 2, 2019

(54) DRIVING STRAIGHT AHEAD DEVICE FOR CONSTRUCTION MACHINE AND CONTROL METHOD THEREFOR

(71) Applicants: VOLVO CONSTRUCTION EQUIPMENT AB, Eskilstuna (SE); Hea-Gyoon Joung, Busan (KR)

(72) Inventors: Hea-Gyoon Joung, Busan (KR); Sung-Gon Kim, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 314 days.

(21) Appl. No.: 15/519,842

(22) PCT Filed: Nov. 5, 2014

(86) PCT No.: PCT/KR2014/010553

§ 371 (c)(1),
(2) Date: Jun. 11, 2017

(87) PCT Pub. No.: WO2016/072535

PCT Pub. Date: May 12, 2016

(65) Prior Publication Data

US 2017/0268201 A1 Sep. 21, 2017

(51) Int. Cl.

| | |
|---|---|
| ***E02F 9/20*** | (2006.01) |
| ***E02F 9/22*** | (2006.01) |
| ***E02F 9/02*** | (2006.01) |
| ***F15B 11/17*** | (2006.01) |

(52) U.S. Cl.

CPC ..... *E02F 9/2004* (2013.01); *E02F 9/02* (2013.01); *E02F 9/2037* (2013.01); *E02F 9/2045* (2013.01); *E02F 9/225* (2013.01); *E02F 9/2239* (2013.01); *E02F 9/2242* (2013.01); *E02F 9/2292* (2013.01); *E02F 9/2296* (2013.01); *F15B 11/17* (2013.01); *E02F 9/2225* (2013.01); *E02F 9/2285* (2013.01)

(58) Field of Classification Search

CPC ..... E02F 9/20; E02F 9/22

See application file for complete search history.

(56) References Cited

U.S. PATENT DOCUMENTS

| | | | | |
|---|---|---|---|---|
| 5,052,179 | A | 10/1991 | Fujii | |
| 6,148,545 | A | 11/2000 | Tohji | |
| 6,474,063 | B2 * | 11/2002 | Sawada | B62D 11/183 60/426 |

(Continued)

FOREIGN PATENT DOCUMENTS

| | | | |
|---|---|---|---|
| CN | 101059138 | A | 10/2007 |
| CN | 102605812 | A | 7/2012 |

(Continued)

OTHER PUBLICATIONS

International Search Report (dated Jul. 22, 2015) for corresponding International App. PCT/KR2014/010553.

(Continued)

*Primary Examiner* — Kira Nguyen
(74) *Attorney, Agent, or Firm* — WRB-IP LLP

(57) ABSTRACT

A straight traveling apparatus for a construction machine and a control method thereof are provided which can allow a curved travel when the working device is operated during the curved travel.

7 Claims, 4 Drawing Sheets

(56) References Cited

U.S. PATENT DOCUMENTS

| | | | | |
|---|---|---|---|---|
| 8,146,355 | B2 * | 4/2012 | Lee | B62D 11/001 60/421 |
| 9,890,801 | B2 * | 2/2018 | Takahashi | F15B 11/17 |
| 2012/0029566 | A1 * | 2/2012 | Rezach | A61B 17/7038 606/264 |
| 2012/0185141 | A1 * | 7/2012 | Kamado | E02F 9/2066 701/50 |

FOREIGN PATENT DOCUMENTS

| | | | |
|---|---|---|---|
| CN | 102888873 | A | 1/2013 |
| JP | H06306892 | A | 11/1994 |
| JP | 2776702 | B2 | 7/1998 |
| JP | 2002021808 | A | 1/2002 |
| JP | 2005201301 | A | 7/2005 |
| KR | 100753990 | B1 | 8/2007 |
| KR | 101156859 | B1 | 6/2012 |
| KR | 101356008 | B1 | 1/2014 |
| WO | 2003089295 | A1 | 6/2013 |

OTHER PUBLICATIONS

Chinese Officiai Action (dated Mar. 4, 2019) for corresponding Chinese App. 201480083191.0.

European Official Action (dated Jun. 28, 2018) for corresponding European App. EP 14 90 5308.

* cited by examiner

[Fig. 1]
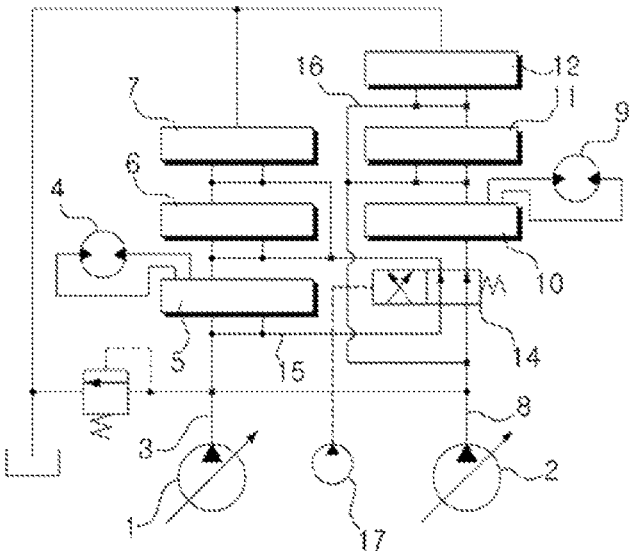
[Fig. 2]
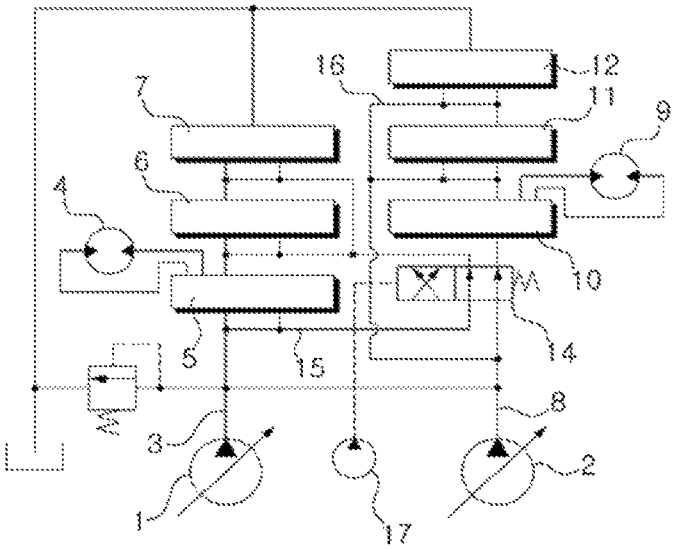
[Fig. 3]
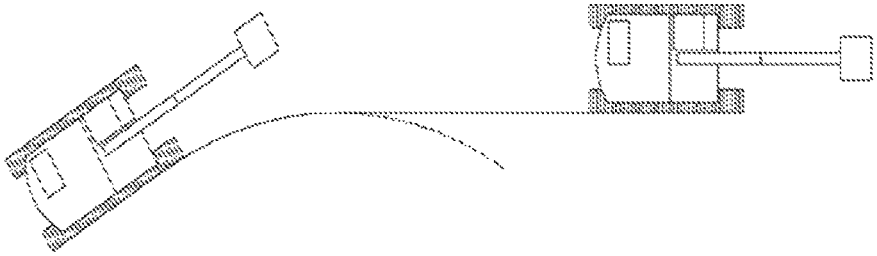

[Fig. 4]
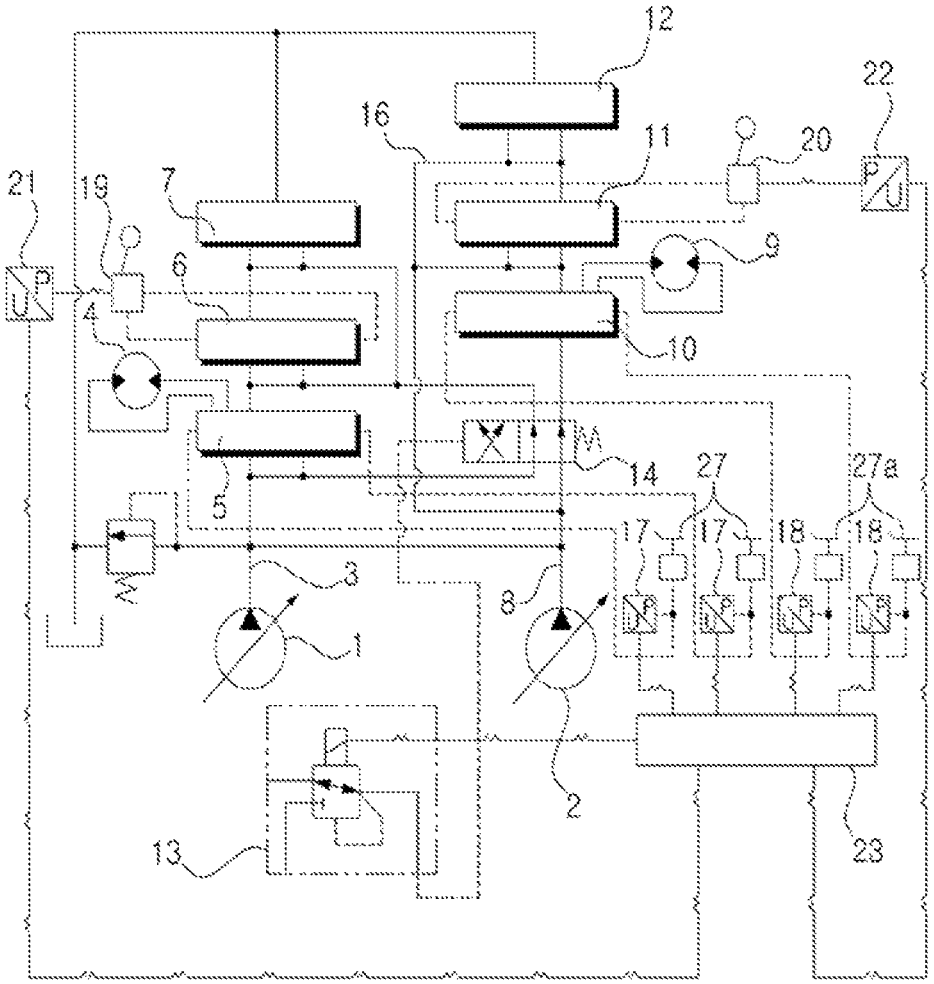

[Fig. 5]
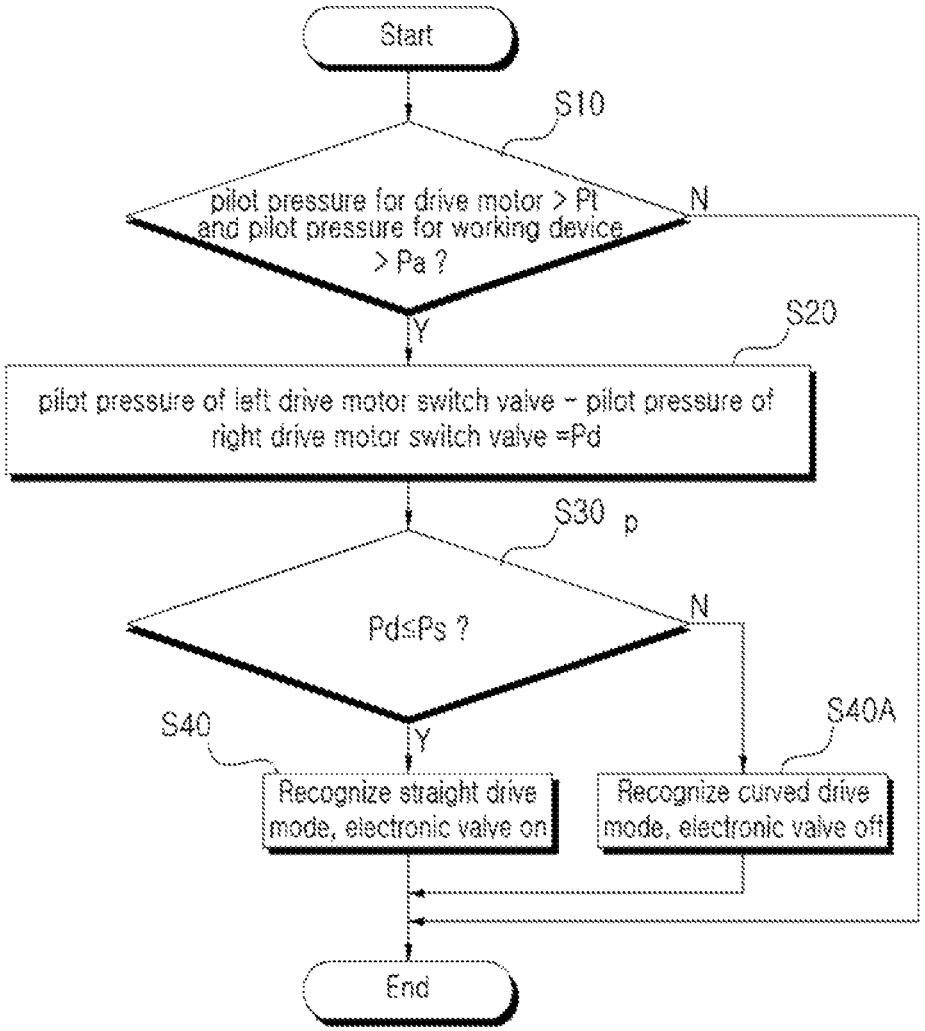

[Fig. 6]
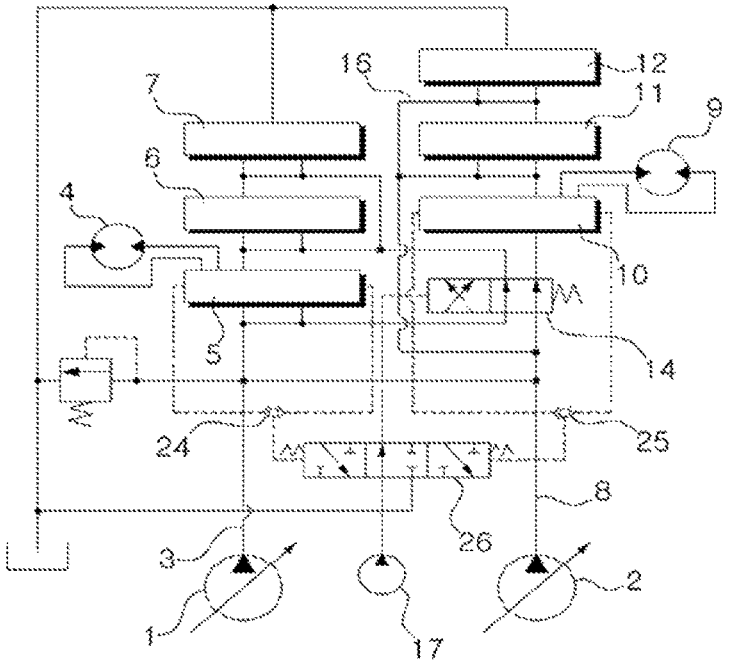
[Fig. 7]
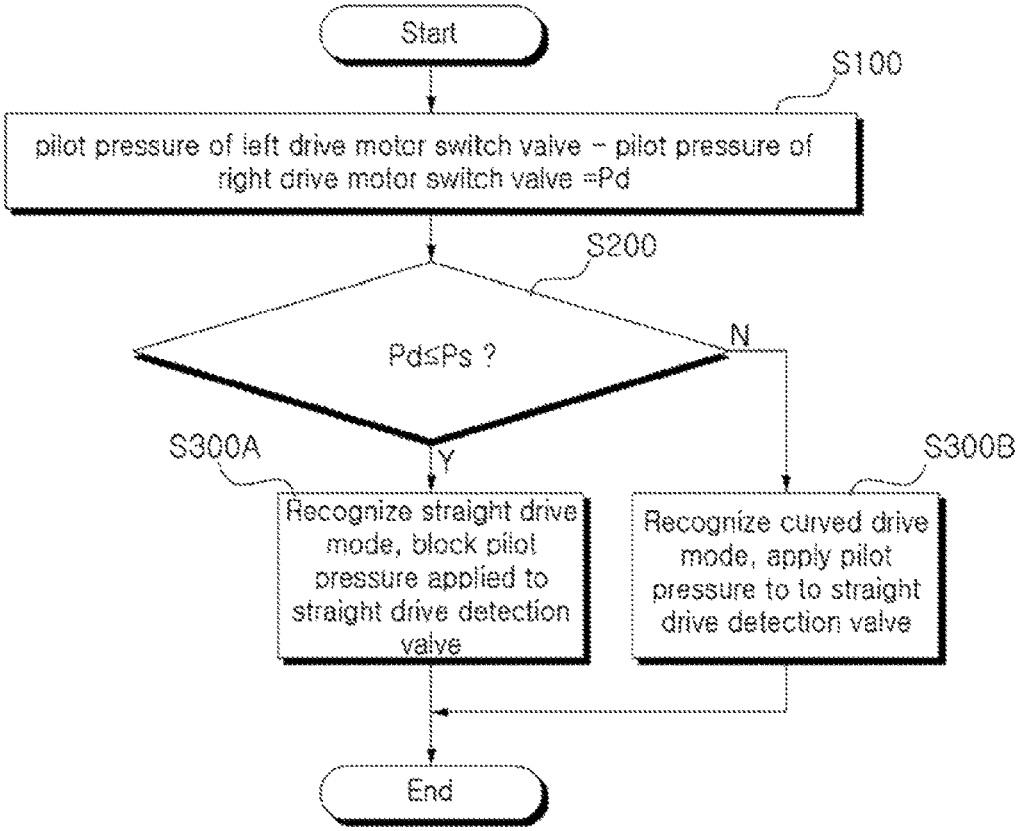

DRIVING STRAIGHT AHEAD DEVICE FOR CONSTRUCTION MACHINE AND CONTROL METHOD THEREFOR

BACKGROUND AND SUMMARY

The present invention relates to a straight traveling apparatus, more specifically, a straight traveling apparatus for a construction machine and a control method thereof, which allows a curved travel when the working devices (boom, arm, etc.) are operated during a travel.

FIG. 1 shows a hydraulic circuit of the straight traveling apparatus which controls the straight travel valve electrically according to the prior art.

As shown in FIG. 1, the first and second variable displacement hydraulic pumps (hereinafter, the first and second hydraulic pumps) (1, 2) and the pilot pump (17) are connected to the engine (not shown).

A first travel control valve (5) and first working control valves (6, 7) are installed in a flow path (3) that is connected to the first hydraulic pump (1). The first travel control valve (5) controls the hydraulic oil that is supplied to the left travel motor (4), and the first working device switch valves (6, 7) controls the hydraulic oil that is supplied to the first working device (e.g. arm).

A second travel control valve (10) and second working control valves (11, 12) are installed in a flow path (8) that is connected to the second hydraulic pump (2). The second travel control valve (10) controls the hydraulic oil that is supplied to the right travel motor (9), and the second working device control valves (11, 12) controls the hydraulic oil that is supplied to the second working device (e.g. boom).

The straight travel valve (14) is installed at an upstream of the flow path (8), which is switched by the pilot pressure applied from the electrical control valve. When the working device, e.g. boom, is operated during a travel, the straight travel control valve (14) is switched so that the hydraulic oil of the first hydraulic pump (1) is supplied to the left travel motor (4) and right travel motor (9), respectively, while the hydraulic oil of the second hydraulic pump (2) is supplied to the first working device and the second working device, respectively.

Thus, some of the hydraulic oil of the first hydraulic pump (1) is supplied to the left travel motor (4) by way of the flow path (3) and the first travel control valve (5), and the rest of the hydraulic oil of the first hydraulic pump (1) is supplied to the first working device by way of the flow paths (3, 15), straight travel valve (14), and first working device switch valve (6, 7).

Also, some of the hydraulic oil of the second hydraulic pump (2) is supplied to the right travel motor (4) by way of the path (8), the straight travel valve (14) and the second travel control valve (10), and the rest of the hydraulic oil of the second hydraulic pump (2) is supplied to the second working device by way of the flow paths (8, 16) and the second working device switch valves (11, 12).

On the other hand, when the working device, e.g. boom, is operated during the travel, the spool of the straight traveling control valve (14) is switched to the right direction in the drawing by the pilot pressure applied from the electrical control valve.

Due to this spool switching, some of the hydraulic oil of the first hydraulic pump (1) is supplied to the left traveling motor (4) by way of the flow path (3) and the first travel control valve (5), and the rest of the hydraulic oil of the first hydraulic pump (1) is supplied to the right travel motor (9) by way of the flow paths (3, 15), the straight travel valve (14), and the second travel control valve (10). Meanwhile, some of the hydraulic oil of the second hydraulic pump (2) is supplied to the first working device by way of the flow path (8), the straight travel valve (14) and the first working device switch valves (6, 7), and the rest of the hydraulic oil of the second hydraulic pump (2) is supplied to the second working device by way of the flow paths (8, 16) and the second working device switch valves (11, 12).

As described above, when the working device, e.g. boom, is operated during the travel, the hydraulic oil of the first hydraulic pump (1) is supplied to the left travel motor (4) and right travel motor (9), respectively, while the hydraulic oil of the second hydraulic pump (2) is supplied to the first working device and the second working device, respectively.

Hence, in case that the working device is operated during the travel, the apparatus can move straight as the single travel can be prevented due to the overload applied to the working device.

FIG. 2 shows the hydraulic circuit of the straight travel apparatus which controls the straight travel valve hydraulically.

As shown in FIG. 2, when the working device, e.g. boom, is operated during the travel, the straight travel valve (14) is switched so that the hydraulic oil of the first hydraulic pump (1) is supplied to the left travel motor (4) and right travel motor (9), respectively, while the hydraulic oil of the second hydraulic pump (2) is supplied to the first working device and the second working device, respectively. The straight travel control valve (14) is installed in the upper side of the path (8), and switched by the pilot pressure applied from the pilot pump (17).

In this case, since the configuration is same as that in FIG. 1 except the pilot pump, the detailed description will be abbreviated with same reference numerals for the overlapping parts in the drawing.

FIG. 3 shows the drive track according to the prior art when the working device is operated during a curved travel.

As shown in FIG. 3, when the working device is operated simultaneously with a straight traveling apparatus in a combined operation with a curved travel along the drive track, the straight travel valve (14) is switched to make a straight travel, and the machine is not put under the curved travel. Thus, when the straight travel valve (14) is switched during the curved travel, it may cause the safety problem to occur since the machine moves straight against the driver's intention for the curved travel.

Accordingly, it is desirable to provide a straight traveling apparatus for the construction machine and a control method thereof, which secures the safety by the curved travel at the driver's intention when the working devices are operated during the curved travel.

In accordance with an aspect of the present invention, there is provided a straight traveling apparatus for a construction machine comprising:

a first and a second variable displacement hydraulic pump and a pilot pump;

a left travel motor and a first working device that are operated by the first variable displacement hydraulic pump;

a plurality of control valves that are installed in a flow path of the first hydraulic pump and control the hydraulic oil supplied to the left travel motor or the first working device;

a right travel motor and a second working device that are operated by the second variable displacement hydraulic pump;

a plurality of control valves that are installed in a flow path of the second variable displacement hydraulic pump and control the hydraulic oil supplied to the right travel motor or the second working device;

a straight travel valve that is switched by the pilot pressure operated by an electrical control valve, the straight travel valve, when being switching, supplying the hydraulic oil of one of the first and second hydraulic variable displacement pumps to the left and right travel motors while supplying the hydraulic oil of the other of the first and second variable displacement hydraulic pumps to the left and right working devices;

a pressure detection sensor for detecting the pilot pressure applied to the left and right travel motor control valves and the pilot pressure applied to the first and second working device control valves; and a controller that outputs a control signal to the electrical control valve so that the pilot pressure applied to the straight travel valve is blocked in case that the difference between the pilot pressures applied to the left and right travel motor control valves is larger than the pre-set pressure value, when the first and second working devices are operated during a travel.

According to the embodiment of an aspect of the present invention having the above-described configuration, a method for controlling a straight traveling apparatus for a construction machine including a left travel motor and a first working device that are operated by a first variable displacement hydraulic pump; a first working device control valve that is installed in a flow path that is connected to the first variable displacement hydraulic pimp; a right travel motor and a second working device that are operated by a second variable displacement hydraulic pump; a second working device control valve that is installed in a flow path that is connected to the second variable displacement hydraulic pump; a straight travel valve that is switched by a pilot pressure applied from an electrical control valve; a pressure detection sensor for detecting the pilot pressures applied to left and right travel motor control valves as well as the first and second working device control valves; and a controller to which the detection signal from the pressure detection sensor is inputted, the method comprising:

a step of detecting the pilot pressures applied to the left and right travel motor control valves as well as the pilot pressures applied to the first and second working device control valves;

a step of calculating a pressure difference between the pilot pressures applied to the left and right travel motor control valves;

a step of comparing the calculated pressure difference with the pre-set pressure value, when the first and second working devices are operated during a travel; and a step of blocking the pilot pressure applied to the straight travel valve from the electrical control valve by recognizing the a curved travel mode when the calculated pressure difference is larger than the pre-set pressure value.

According to another embodiment of an aspect of the present invention having the above-described configuration, a straight traveling apparatus for a construction machine comprising:

a first and a second variable displacement hydraulic pumps and a pilot pump;

a left travel motor and a first working device that are operated by the first variable displacement hydraulic pump;

a plurality of control valves that are installed in a path that is connected to the first variable displacement hydraulic pump and control the hydraulic oil supplied to the left travel motor or the first working device;

a right travel motor and a second working device that are operated by the second variable displacement hydraulic pump;

a plurality of control valves that are installed in a path that is connected to the second variable displacement hydraulic pump and control the hydraulic oil supplied to the right travel motor or the second working device;

a straight travel valve that is switched by a pilot pressure applied from the pilot pump and supplies an hydraulic oil that is discharged from one of the first and second variable displacement hydraulic pumps to the left and right travel motors while supplying an hydraulic oil that is discharged from the other of the first and second variable displacement hydraulic pumps to the left and right working devices; and a straight travel detection valve that is installed in a flow path between the pilot pump and the straight travel valve, wherein the straight travel detection valve is switched and blocks the pilot pressure applied to the straight travel valve in case that a pressure difference between the pilot pressures applied to the left and right travel motor control valves is larger than the pre-set pressure value of a valve spring at both ends of the straight travel detection valve, when the first and second working devices are operated during a travel.

Preferably, the electrical control valve includes a solenoid valve, the proportional pressure reducing valve being adjusted to allow the pilot pressure from the pilot pump to the straight travel valve, in response to an electrical signal that is applied from the controller.

More preferably, the electrical control valve includes a proportional pressure reducing valve, wherein an hydraulic oil supplied from the pilot pump is converted to a pilot pressure in response to the electrical signal applied from the controller, and the pilot pressure is applied to the straight travel valve.

A first and second shuttle valves are provided, the first shuttle valve for selecting the pilot pressure which is relatively higher between the pilot pressures at both ends of the left travel motor control valve, and applying the selected pilot pressure to one pressure receiving port of the straight travel detection valve; and the second shuttle valve for selecting the pilot pressure which is relatively higher between the pilot pressures at both ends of the right travel motor control valve, and applying the selected pilot pressure to the other pressure receiving port of the straight travel detection valve.

When the difference between the pilot pressures is below the pre-set pressure value, the straight travel mode is recognized and the pilot pressure from the electrical control valve is applied to the straight travel valve to be switched.

According to an aspect of the present invention having the configuration described above, when the working device is operated simultaneously with the straight traveling apparatus in a combined operation during the curved travel, the straight travel mode is blocked and the machine is allowed for the curved travel, so that it has the effect of protecting the driver and machine from the safety accident.

BRIEF DESCRIPTION OF THE DRAWINGS

FIG. 1 shows the hydraulic circuit of the straight traveling apparatus which controls the straight travel valve electrically according to the conventional technology.

FIG. 2 shows the hydraulic circuit of the straight traveling apparatus which controls the straight travel valve hydraulically according to the conventional technology.

FIG. 3 shows the drive track according to the conventional technology when the working device is operated during the curved travel.

FIG. 4 shows the hydraulic circuit of the electrical straight traveling apparatus for the construction machine according to the embodiment of an aspect of the present invention.

FIG. 5 shows the flow chart for the control method of the electrical straight traveling apparatus for the construction machine according to the embodiment of an aspect of the present invention.

FIG. 6 shows the hydraulic circuit of the electrical straight traveling apparatus for the construction machine according to another embodiment of an aspect of the present invention.

FIG. 7 shows the flow chart for the control method of the electrical straight traveling apparatus for the construction machine according to another embodiment of an aspect of the present invention.

1; first variable displacement hydraulic pump
2; second hydraulic pump
3, 8; flow path
4; left travel motor
5; first travel motor control valve
6; first working device control valve
9; right travel motor
10; second travel motor control valve
11; second working device control valve
13; electrical control valve
14; straight travel valve
17, 18, 21, 22; pressure sensor
19, 20; joystick
23; controller
24; first shuttle valve
25; second shuttle valve
26; straight travel detection valve
27, 27*a*; drive pedal

DETAILED DESCRIPTION

Hereinalter, according to the preferred embodiment of the present invention, a straight traveling apparatus for the construction machine and a control method thereof will be described in detail with reference to the drawings attached.

FIG. 4 shows the hydraulic circuit of the electrical straight traveling apparatus for the construction machine according to the embodiment of the present invention. FIG. 5 shows the flow chart for the control method of the electrical straight traveling apparatus for the construction machine according to the embodiment of the present invention. FIG. 6 shows the hydraulic circuit of the electrical straight traveling apparatus for the construction machine according to another embodiment of the present invention. FIG. 7 shows the flow chart for the control method of the electrical straight traveling apparatus for the construction machine according to another embodiment of the present invention.

Referring to FIG. 4, the straight traveling apparatus for the construction machine according to the embodiment of the present invention, the first and second variable displacement hydraulic pumps (hereinafter, the first and second hydraulic pumps) (1, 2) and the pilot pump (not drawn) are connected to the engine.

A first travel control valves (5) and first working control valves (6, 7) are installed in a flow path (3) that is connected to the first hydraulic pump (1). The first control valve(5) controls the hydraulic oil that is supplied to the left travel motor(4) and the first working device control valves (6, 7) controls the hydraulic oil that is supplied to the first working device (e.g. arm).

A second travel control valve (10) and second working control valves (11, 12) are installed in a flow path (8) that connected to the second hydraulic pump (2). The second control valve (10) controls the hydraulic oil that is supplied to the right travel motor (9) and the second working device control valves (11, 12) controls the hydraulic oil that is supplied to the second working device (e.g. boom).

The straight travel valve (14) is installed in the upstream of the path (8), which is switched by the pilot pressure operated by the electrical control valve (13). When the working device, e.g. boom, is operated during the travel, the straight travel valve (14) is switched so that the hydraulic oil of the first hydraulic pump (1) is supplied to the left travel motor (4) and right travel motor (9), respectively, while the hydraulic oil of the second hydraulic pump (2) is supplied to the first working device and the second working device, respectively.

Although not shown in the drawing, the straight travel valve (14) is installed in the upstream of the path (3) of the first hydraulic pump (1). When the working device, e.g. boom, is operated during the travel, the straight travel valve (14) is switched so that the hydraulic oil of the second hydraulic pump (2) is supplied to the left travel motor (4) and right travel motor (9), respectively, while the hydraulic oil of the second hydraulic pump (1) is supplied to the first working device and the second working device, respectively.

The pressure sensors (17, 18) are installed in the path between the drive pedals (27, 27*a*) and the first and second travel motor control valves (5, 10), and detect the pilot pressures applied to the first and second travel motor control valves (5, 10) by the drive pedals (27, 27*a*).

The pressure sensors (21, 22) are installed in the path between the joy sticks (19. 20) and the first and second working device switch valves (6, 7, 11, 12), and detect the pilot pressures applied to the first and second working device control valves (6, 7, 11, 12) by the joy sticks (19,20).

The controller (23) that is connected to the pressure sensors (17, 18, 21, 22) and the electrical control valve (13), and outputs a control signal to the electrical control valve (13) so that the pilot pressure applied to the straight travel valve (14) is blocked in case that a difference (Pd) between the pilot pressures applied to the first and second travel motor control valves (5,10) is larger than the pre-set pressure value (Ps), when the first and second working devices are operated during the travel.

More preferably, the electrical control valve includes a solenoid valve (not shown in figure), in which the solenoid valve is adjusted between an initial state position and an on-state position by a control signal that is provided from the controller (23), wherein the solenoid valve is switched for blocking the pilot pressure that is applied to the straight travel valve (14) from the pilot pump (17) at the initial state position, and for supplying the pilot pressure from the pilot pump (17) to the straight travel valve (14) at the on-state position.

More preferably, the electrical control valve includes a proportional pressure reducing valve (PPRV), the proportional pressure reducing valve being adjusted to allow the pilot pressure from the pilot pump to the straight travel valve (14), in response to an electrical signal that is applied from the controller (23).

Referring to FIG. 5, according to the embodiment of the present invention, a method for controlling a straight traveling apparatus for a construction machine including:

a left travel motor (4) and a first working device (e.g. arm) that are operated by the first variable displacement hydraulic pump (1); a first left travel motor control valve (5) and a first working device control valve (6, 7) that are installed in the flow path (3) that is connected to the first variable displacement hydraulic pump (1) and are switched by the pilot pressure; a right travel motor (9) and a second working device (e.g. boom) that are operated by the second variable displacement hydraulic pump (2); a second right travel motor control valve (10) and a second working device control valve (11, 12) that are installed in a flow path (8) that is connected to the second variable displacement hydraulic pump (2) and are switched by the pilot pressure; a straight travel valve (14) that is installed in the upstream of the flow path (8) of the second variable displacement hydraulic pump (2) and is switched by the pilot pressure applied from the electrical control valve (13) when the first and second working devices are operated during the travel; a pressure detection sensors (17, 18, 21, 22) for detecting the pilot pressures applied to the left and right travel motor control valves (5,10) as well as the first and second working device control valves (6, 7, 11, 12); and a controller (23) to which the detection signals from the pressure detection sensor (17, 18, 21, 22) are inputted, the method comprises a step (S10) of detecting the pilot pressures applied to the first and second travel motor control valves (5,10) as well as the pilot pressures applied to the first and second working device switch valves (6, 11), and inputting the detected signals to the controller (23);

a step (S20) of calculating a pressure difference between the pilot pressures applied to the first and second travel motor control valves;

a step (S30) of comparing the calculated pressure difference (Pd) with the pre-set pressure value (Ps), when the first and second working devices are operated during a travel;

a step (S40) of recognizing a straight travel mode when the calculated difference (Pd) is below the pre-set pressure value (Ps), and switching the straight travel valve (14) by a pilot pressure applied from the electrical control valve (13); and, a step (S40A) of recognizing a curved travel mode when the calculated difference (Pd) is larger than the pre-set pressure value (Ps) and blocking the pilot pressure applied to the straight travel valve (14) from the electrical control valve (13).

According to the configuration described above, as in S10, when the joystick (19, 20) is manipulated, the detected pilot pressures applied to the first and second working device control valves (6, 11) are inputted to the controller (23). Also, when the drive pedals (27, 27*a*) are manipulated, the detected pilot pressures applied to the first and second travel motor control valves (5, 10) are inputted to the controller (23).

Hence, if the pilot pressures applied to the first and second travel motor control valves (5, 10) are detected to be higher than the pre-set pressure (Pt), while the pilot pressures applied to the first and second working device control valves (6, 11) are detected to be higher than the pre-set pressure (Pa) (which is the case of operating the working device during the travel), then the controller (23) makes it proceed to "S20".

On the contrary, if the pilot pressures applied to the first and second travel motor control valves (5,10) are detected to be lower than the pre-set pressure (Pt), while the pilot pressures applied to the first and second working device switch valves (6, 7, 11, 12) are detected to be lower than the pre-set pressure (Pa), then the operation process is stopped.

As in S20, the pressure difference (Pd) between the pilot pressure applied to the left first travel motor control valve (5) and the right second travel motor switch valve (10) is calculated. At this time, the calculated pressure difference is taken as the absolute value. After calculation, it proceeds to "S30".

As in S30, if the calculated pressure difference (Pd) is smaller than the pre-set pressure value (Ps), the straight travel mode is recognized and it proceeds to "S40".

Also, if the calculated pressure difference (Pd) in the pilot pressure is larger than the pre-set pressure value (Ps), the curved travel mode is recognized and it proceeds to "S40A".

As in S40, in order to generate the straight travel mode when the working device is operated during the travel, the electrical signal is inputted from the controller (23) to the electric control valve (13) (e.g. solenoid valve or proportional pressure reducing valve). Thus, if the solenoid valve is used for the electrical control valve (13), the solenoid valve is switched to the on-state position when the electrical signal is applied from the controller (23), and then the pilot pressure passing through the solenoid valve from the pilot pump is applied to the straight travel valve (14) and thereby switches the spool of the to the right direction in the figure.

On the other hand, if the proportional pressure reducing valve (PPRV) is used for the electrical control valve (13), the hydraulic oil supplied from the pilot pump is converted to the pilot pressure in response to the electrical signal applied from the controller (23), and the converted pilot pressure is applied to the straight travel valve (14) and thereby switches the spool.

Accordingly, when the straight travel valve (14) is switched, some of the hydraulic oil discharged from the first variable displacement hydraulic pump (1) is supplied to the left travel motor (4) by way of the left first travel motor control valve (5) while some of the hydraulic oil discharged from the first variable displacement hydraulic pump (1) is supplied to the right travel motor (9) by way of the straight travel valve (14) and the right second travel motor control valve (10).

Meanwhile, when the straight travel valve (14) is switched, some of the hydraulic oil discharged from the second variable displacement hydraulic pump (2) is supplied to the first working device (e.g. arm) thru the first working device control valve (6, 7) by way of the straight travel valve (14) while some of the hydraulic oil discharged from the second variable displacement hydraulic pump (2) is supplied to the second working device (e.g. boom) by way of the second working device control valve (11, 12).

Therefore, when the working device is operated during the straight travel, the machine can drive straight since a single travel is prevented even under the load of the working device.

As in 40A, when the working device is operated during the curved travel, the electrical signal applied to the electrical control valve (13) from the controller (23) is blocked for blocking the straight travel function of a straight travel mode. Thus, the pilot pressure applied to the straight travel valve (14) by the electrical control valve (13) is blocked.

Hence, as the straight travel valve (14) maintains the initial state position of non-straight travel function due to the elastic force of valve spring, some of the hydraulic oil of the first variable displacement hydraulic pump (I) is supplied to the left travel motor (4) by way of the left first travel motor control valve (5) while some of the hydraulic oil of the first variable displacement hydraulic pump (1) is supplied to the first working device thru the first working device control valve (6, 7) by way of the straight travel valve (14).

Also, some of the hydraulic oil discharged from the second variable displacement hydraulic pump (2) is supplied to the right travel motor (9) by way of the straight travel valve (14) and the right second travel motor control valve (10), while some of the hydraulic oil discharged from the second variable displacement hydraulic pump (2) is supplied to the second working device (e.g. boom) by way of the second working device control valve (11, 12).

Thus, when the working device is operated during the curved travel, the straight travel function is blocked, and the left and right travel motors (4, 9) are operated by the hydraulic oil supplied from the first and second variable displacement hydraulic pumps (1, 2) in response to an amount of the pilot pressure that is generated by a manipulation of the drive pedals (27, 27*a*), thereby enabling the machine to make the curved travel at the driver's intention.

Referring to FIG. 6, the straight traveling apparatus for the construction machine according to the embodiment of the present invention, the first and second variable displacement hydraulic pumps (hereinafter, the first and second hydraulic pumps) (1, 2) and the pilot pump (17) are connected to the engine (not shown).

In the path (3) of the first hydraulic pump (1) are installed the first control valve (5) for controlling the hydraulic oil that is supplied to the left travel motor (4) and the first working device control valve (6, 7) for controlling the hydraulic oil that is supplied to the first working device (e.g. arm).

In the path (8) of the second hydraulic pump (2) are installed the second control valve (10) for controlling the hydraulic oil that is supplied to the right travel motor (9) and the second working device control valve (11, 12) for controlling the hydraulic oil that is supplied to the second working device (e.g. boom).

The straight travel valve (14) is installed in the upstream of a flow path (8), which is switched by the pilot pressure applied from the electrical control valve (13). When the working device, e.g. boom, is operated during a travel, the straight travel valve (14) is switched so that the hydraulic oil discharged from the first hydraulic pump (1) is supplied to the left travel motor (4) and right travel motor (9), respectively, while the hydraulic oil discharged from the second hydraulic pump (2) is supplied to the first working device and the second working device, respectively.

Although not shown in the drawing, the straight travel valve (14) is installed in the upstream of the flow path (3) of the first hydraulic pump (1). When the working device, e.g. boom, is operated during the travel, the straight travel valve (14) is switched so that the hydraulic oil of the second hydraulic pump (2) is supplied to the left travel motor (4) and right travel motor (9), respectively, while the hydraulic oil discharged from the second hydraulic pump (1) is supplied to the first working device and the second working device, respectively.

A straight travel detection valve (26) is installed in a flow path between the pilot pump (17) and the straight travel valve (14), wherein the straight travel detection valve (26) is switched and the pilot pressure is blocked if the difference (Pd) between the pilot pressures applied to the left and right travel motor control valves (5, 10) is greater than a pre-set pressure of the valve spring at both ends of the straight travel detection valve (26) when the first and second working devices are operated during the travel.

A first shuttle valve (24) is provided in flow paths between the left travel motor control valves (5) and the straight travel detection valve (26), wherein a first shuttle valve selects the pilot pressure which is relatively higher between the pilot pressures applied at both ends of the left travel motor control valve (5), and applies the selected pilot pressure to one pressure port of the straight travel detection valve (26).

Also, a second shuttle valve (25) is provided in the path between the right travel motor control valves (10) and the straight travel detection valve (26), wherein second shuttle valve (25) selects the pilot pressure which is relatively higher between the pilot pressures applied at both ends of the right travel motor control valve (10), and applies the selected pilot pressure to the other pressure port of the straight travel detection valve (26).

Referring to FIG. 7, according to the embodiment of the present invention, a method for controlling a straight traveling apparatus for a construction machine including;

a left travel motor (4) and a first working device (e.g. arm) that are operated by the first hydraulic pump (1); a left travel motor control valve (5) and a first working device switch valve (6, 7) that are installed in a flow path (3) of the first hydraulic pump (1) and are switched by a pilot pressure; a right travel motor (9) and a second working device (e.g. boom) that are operated by the second hydraulic pump (2); a right travel motor control valve (10) and the first and second working device control valves (11, 12) that are installed in a flow path (8) of the second hydraulic pump (2) and are switched by a pilot pressure; a straight travel valve (14) that is installed in the upstream of the flow path (8) of the second hydraulic pump (8) and is switched by a pilot pressure applied from pilot pump (17); and a straight travel detection valve (26) that is installed in a flow path between the pilot pump (17) and the straight travel valve (14), the method comprises:

a step (S100) calculating a pressure difference (Pd) between the pilot pressures applied to the left and right travel motor control valves (5,10);

a step (S200) of comparing the calculated pressure difference (Pd) with the pre-set pressure value (Ps) of the valve spring at both ends of the straight travel detection valve (26), when the first and second working devices are operated during a travel;

a step (S300A) of recognizing a straight travel mode when the calculated pressure difference (Pd) is smaller than the pre-set pressure value (Ps) of the valve spring and switching the straight travel valve (14) by the pilot pressure applied from the pilot pump (17); and, a step (S300B) of recognizing a curved travel mode when the calculated pressure difference (Pd) is larger than the pre-set pressure value (Ps) of the valve spring and blocking the pilot pressure applied to the straight travel valve (14) from the pilot pump (17).

According to the configuration described above as in S100, the first shuttle valve (24) selects a pilot pressure which is relatively higher between each of the pilot pressures that are induced or applied from both ends of the left travel motor control valve (5). The second shuttle valve (25) selects a pilot pressure which is relatively higher between each of the pilot pressures that are induced or applied from both ends of the right travel motor control valve (10).

The pressure difference (Pd) in the pilot pressure is calculated by comparing the pilot pressure that is selected from the pilot pressures of the left travel motor control valve (5) by the first shuttle valve (24) and induced to one pressure receiving port of the straight travel detection valve (26), and the pilot pressure that is selected from the pilot pressures of the right travel motor control valve (10) by the second shuttle valve (25) and induced to the other pressure receiving port of the straight travel detection valve (26). At this time, the pressure difference (Pd) is taken as the absolute value. After calculation, it proceeds to "S200".

As in S200, the calculated pressure difference (Pd) is compared with the pre-set pressure value (Ps) of the valve spring at both ends of the straight travel detection valve (26). If the calculated pressure difference (Pd) is smaller than the pre-set pressure value (Ps) of the valve spring, it proceeds to "S300A" as a straight travel mode is recognized.

On the other hand, if the calculated difference (Pd) is larger than the pre-set pressure value (Ps) of the valve spring, it proceeds to "S300B" as a curved travel mode is recognized.

As in S300A, since the pressure difference (Pd) between both pressure receiving ports of the straight travel detection valve (26), which is induced from the first and second shuttle valve (24, 25), is smaller than the pre-set pressure value (Ps) of the valve spring at both ends of the straight travel detection valve (26), the straight travel detection valve (26) maintains the neutral position due to the pre-set pressure (Ps) of the valve spring when the working device is operated during the travel. Thus, the pilot pressure of the pilot pump (17) is applied to the straight travel valve (14) through the straight travel detection valve (26).

Hence, as the spool of the straight travel valve (14) is switched to the right direction in the drawing, some of the hydraulic oil that is discharged from the first hydraulic pump (1) is supplied to the left travel motor (4) by way of the left travel motor control valve (5) while some of the hydraulic oil that is discharged from the first hydraulic pump (1) is supplied to the right travel motor (9) by way of the straight travel valve (14) and the right travel motor control valve (10).

At the same time, some of the hydraulic oil that is discharged from the first hydraulic pump (2) is supplied to the first working device through the first working device control valve (6, 7) by way of the straight travel valve (14), while some of the hydraulic oil that is discharged from the first hydraulic pump (2) is supplied to the second working device by way of the second working device control valve (11, 12).

Therefore, when the working device is operated during the straight travel, the machine can drive straight since the single travel is prevented even under the load of the working device.

As in 300B, since the pressure difference (Pd) between the pilot pressures induced to both pressure receiving ports of the straight travel detection valve (26) from the first and second shuttle valve (24, 25) is greater than the pre-set pressure value (Ps) of the valve spring of the straight travel detection valve (26), the straight travel detection valve (26) is switched to either left or right direction when the working device is operated during the travel. Thus, the pilot pressure applied to the straight travel valve (14) from the pilot pump (17) is blocked.

Hence, as the straight travel valve (14) maintains the initial state of non-straight travel function of the straight travel valve (14) due to the elastic force of valve spring, some of the hydraulic oil that is discharged from the first hydraulic pump (1) is supplied to the left travel motor (4) by way of the left travel motor control valve (5) while some of the hydraulic oil that is discharged from the first hydraulic pump (1) is supplied to the first working device thru the first working device control valve (6, 7) by way of the straight travel valve (14).

Also, some of the hydraulic oil that is discharged from the first hydraulic pump (2) is supplied to the right travel motor (9) by way of the straight travel valve (14) and the right travel motor control valve (10), while some of the hydraulic oil that is discharged from the first hydraulic pump (2) is supplied to the second working device (e.g. boom) by way of the second working device control valve (11, 12).

Thus, when the working device is operated during the curved travel, the straight travel function is blocked, and the left and right travel motors (4, 9) are operated by the hydraulic oil that is supplied from the first and second hydraulic pumps (1, 2) in response to the pressures that is generated by a manipulation of the drive pedals, thereby enabling the machine to make the curved travel at the driver's intention.

Although the preferred embodiments have been described in the above with reference to the drawings, it is to be understood that various equivalent modifications and variations of the embodiments can be included in the scope of the present invention as recited in the claims.

INDUSTRIAL APPLICABILITY

According to the present invention having the above-described configuration, when the working device is operated during the curved travel of the construction machine such as excavator, the straight travel function is blocked and the curved travel can be maintained.

What is claimed is:

1. A straight traveling apparatus for a construction machine comprising:

a first and a second variable displacement hydraulic pumps and a pilot pump;

a left travel motor and a first working device that are operated by the first variable displacement hydraulic pump;

a plurality of control valves that are installed in a flow path of the first variable displacement hydraulic pump and control the hydraulic oil supplied to the left travel motor or the first working device;

a right travel motor and a second working device that are operated by the second variable displacement hydraulic pump;

a plurality of control valves that are installed in a flow path of the second variable displacement hydraulic pump and control the hydraulic oil supplied to the right travel motor or the second working device;

a straight travel valve that is switched by a pilot pressure induced from an electrical control valve, the straight travel valve, when being switched, supplying the hydraulic oil of one of the first and second variable displacement hydraulic pumps to the left and right travel motors while supplying the hydraulic oil of the other of the first and second variable displacement hydraulic pumps to the left and right working devices:

a pressure detection sensor for detecting a pilot pressure applied to the left and right travel motor control valves and the pilot pressure applied to the first and second working device control valves; and a controller that outputs a control signal to the electrical control valve so that the pilot pressure applied to the straight travel valve is blocked in case that a pressure difference between the pilot pressures applied to the left and right travel motor control valves is larger than a pre-set pressure value, when the first and second working devices are operated during a travel.

2. The straight traveling apparatus for a construction machine of claim 1, wherein the electronical control valve includes a solenoid valve, in which the solenoid valve is adjusted between an initial state position and an on-state position by a control signal that is applied from the controller, wherein the solenoid valve is switched for blocking the pilot pressure that is applied to the straight travel valve from the pilot pump at the initial state position, and for supplying the pilot pressure from the pilot pump to the straight travel valve at the on-state position.

3. The straight traveling apparatus for a construction machine of claim 1, wherein the electrical control valve includes a proportional pressure reducing valve, the proportional pressure reducing valve being adjusted to allow the pilot pressure from the pilot pump to the straight travel valve, in response to an electrical signal that is applied from the controller.

4. A straight traveling apparatus for a construction machine comprising:

a first and a second variable displacement hydraulic pump and a pilot pump;

a left travel motor and a first working device that are operated by the first variable displacement hydraulic pump;

a plurality of control valves that are installed in a flow path of the first variable displacement hydraulic pump and control the hydraulic oil supplied to the left travel motor or the first working device;

a right travel motor and a second working device that are operated by the second variable displacement hydraulic pump;

a plurality of control valves that are installed in a flow path of the second variable displacement hydraulic pump and control the hydraulic oil supplied to the right travel motor or the second working device;

a straight travel valve that is switched by a pilot pressure applied from the pilot pump and supplies the hydraulic oil of one of the first and second variable displacement hydraulic pumps to the left and right travel motors while supplying the hydraulic oil of the other of the first and second variable displacement hydraulic pumps to the left and right working devices; and a straight travel detection valve that is installed in a flow path between the pilot pump and the straight travel valve, wherein the straight travel detection valve is switched and blocks the pilot pressure applied to the straight travel valve in case that a pressure difference between each of the pilot pressures applied to the left and right travel motor control valves is larger than the pre-set pressure value of the valve spring at both ends of the straight travel detection valve, when the first and second working devices are operated during a travel.

5. The straight traveling apparatus for a construction machine of claim 4, further comprising:

a first shuttle valve for selecting the pilot pressure which is relatively higher between the pilot pressures at both ends of the left travel motor control valve, and applying the selected pilot pressure to one pressure receiving port of the straight travel detection valve; and, a second shuttle valve for selecting the pilot pressure which is relatively higher between the pilot pressures at both ends of the right travel motor control valve, and applying the selected pilot pressure to the other pressure receiving port of the straight travel detection valve.

6. A method for controlling a straight traveling apparatus for a construction machine including a left travel motor and a first working device that are operated by the first hydraulic pump; a first working device control valve that is installed in the a flow path that is connected to the first hydraulic pump; a right travel motor and a second working device that are operated by the second hydraulic pump; a second working device control valve that is installed in a flow path that is connected to the second hydraulic pump; a straight travel valve that is switched by a pilot pressure induced from an electrical control valve; a pressure detection sensor for detecting the pilot pressures applied to the left and right travel motor control valves as well as the first and second working device control valves; and a controller to which a detection signal from the pressure detection sensor is inputted, the method comprising:

a step of detecting the pilot pressures applied to the left and right travel motor switch valves as well as the pilot pressures applied to the first and second working device control valves;

a step of calculating a pressure difference between each of the pilot pressures applied to the left and right travel motor control valves;

a step of comparing the calculated pressure difference with the pre-set pressure value, when the first and second working devices are operated during a travel; and a step of recognizing a curved travel mode when the calculated difference is larger than the pre-set pressure value and blocking the pilot pressure applied to the straight travel valve from the electrical control valve.

7. The method for controlling a straight traveling apparatus for a construction machine of claim 6, further comprising a step of recognizing a straight travel mode when the calculated difference is below the pre-set pressure value and switching the straight travel valve by the pilot pressure that is induced from the electrical control valve.

* * * * *